US005729933A

United States Patent [19]

Strength

[11] Patent Number: 5,729,933

[45] Date of Patent: Mar. 24, 1998

[54] UNITARY CORNICE APPARATUS

[76] Inventor: Adam B. Strength, Suite 1390, 1 Jackson Pl., Jackson, Miss. 39201

[21] Appl. No.: 427,269

[22] Filed: Apr. 24, 1995

[51] Int. Cl.[6] ..... E04B 7/00

[52] U.S. Cl. ..... 52/96; 52/94; 52/95; 52/11; 52/58

[58] Field of Search ..... 52/94, 95, 96, 52/11, 58

[56] References Cited

U.S. PATENT DOCUMENTS

| | | | |
|---|---|---|---|
| 3,098,322 | 7/1963 | Greene | 52/11 |
| 3,344,563 | 10/1967 | Miles et al. | 52/11 |
| 3,436,877 | 4/1969 | Gunning | 52/11 |
| 3,815,302 | 6/1974 | Monroe | 52/94 |
| 3,826,048 | 7/1974 | Merken et al. | 52/11 |
| 4,092,808 | 6/1978 | Malone, Jr. et al. | 52/11 |
| 4,263,756 | 4/1981 | Middleby | 52/11 |
| 4,461,128 | 7/1984 | Knoell | 52/94 |

FOREIGN PATENT DOCUMENTS

| | | | |
|---|---|---|---|
| 571232 | 3/1993 | Japan | 52/11 |

*Primary Examiner*—Carl D. Friedman
*Assistant Examiner*—David J. Jersen
*Attorney, Agent, or Firm*—Rodger H. Flagg

[57] ABSTRACT

A unified cornice apparatus formed of metal or plastic, which is secured at one end by a roof nailer portion to the roof decking by conventional fasteners. A shingle mold portion extends from the roof nailer portion. The shingle mold portion has an outer face portion and a bottom face portion. A facia portion extends from the bottom face portion adjacent to the facia board. The facia portion extends beneath the facia board, to a bottom facia portion which extends in spaced relation beneath the facia board. An outer soffit portion extends upwardly from the bottom facia portion to a soffit portion which extends beneath the sub-facia to an inner soffit portion. The inner soffit portion extends downwardly from the inner soffit portion to an lower freeze portion. The lower freeze portion joins a bottom freeze portion, which is secured to an existing wall freeze portion. Alternately, the lower freeze portion connects to an outer wall freeze portion which extends upwardly to a hidden nailer portion. The hidden nailer portion is secured beneath the sub-facia in proximity to the upper portion of the outer wall of the building structure. The unitary cornice apparatus is made of a single molded or formed metal or plastic element extending from the roof nailer to the hidden nailer.

20 Claims, 4 Drawing Sheets

UNITARY CORNICE APPARATUS

BACKGROUND OF THE INVENTION

This invention relates to building structures, and more specifically to a unitary cornice apparatus, made of one unitary piece, for covering and protecting the sub-facia, the soffit, and the upper portion of the outer wall of a building structure, such as a home or office or other commercial building.

Most conventional building systems employ wood rafters, which extend from six to twenty-four inches beyond the outer wall. Typically, the rafters and sub-facia support roof decking which forms the base of the roof. Shingles or other roofing materials cover the roof decking. A facia panel typically covers the outer portion of the sub-facia to protect the sub-facia from the elements, and to provide a decorative cover. A separate soffit typically extends between the outer wall, and the bottom portion of the facia. The outer wall is typically constructed of brick, masonry or wood construction. Because of the high maintenance of wood construction, which requires repainting every several years, the wood construction is often covered with a decorative and protective siding, such as aluminum or vinyl siding.

The labor required to install several component parts, such as the facia panel, the soffit and the interface between the outer wall and the soffit, adds time and expense to the construction of a conventional building structure.

Water flowing over the lower edge of the shingles has a tendency to pass by capillary action upwardly beneath the shingles or roofing, causing water damage to the roof decking, the facia board, the soffit, and to the outer wall. In Winter, the trapped water may freeze, causing further serious damage to the building structure. In winter, snow and ice on the roof may be melted by changing weather patterns, or the heat from within the building structure, adding to the problem.

Prior art devices, such as 3,344,563 issuing to R. T. Miles et al. on Oct. 3, 1967, and U.S. Pat. No. 4,092,808 issuing to John Maloney Jr. et al on Jun. 6, 1978 are representative of the use of multiple component parts to cover the facia, sub-facia and upper portion of the outer wall.

U.S. Pat. No. 3,098,322 issuing to George Green on Jul. 23, 1963 discloses a structural eves covering having a narrow channel at the interface between the roof decking and the facia for mounting a gutter.

U.S. Pat. No. 3,826,048 issuing to Bill Merkin et al. on Jul. 30, 1974 discloses a multiple component gutter, fascia and soffit utilizing high strength brackets and downwardly directed steps.

Therefore, what is needed, is an improved way to protect the interface between the roof decking, the facia, the soffit and the upper portion of the outer wall of a building structure.

SUMMARY OF THE INVENTION

The present invention comprises a unitary cornice apparatus formed of metal or plastic, which is secured at one end by a roof nailer portion to the roof decking and at the opposite end to a hidden nailer portion adjacent to the outer wall. A shingle mold portion extends from the facia, adjacent to the roof nailer. The shingle mold portion has an outer face portion and a bottom face portion which extends to the facia portion adjacent to the facia board. The facia portion includes a bottom facia portion which extends in spaced relation beneath the sub-facia. An outer soffit mold portion extends upwardly from the bottom facia portion, across the bottom portion of the sub-facia, where it extends downwardly along the inner soffit portion to a freeze portion connected to an inclined freeze face portion. A lower freeze portion extends downwardly from the inclined freeze portion, where it forms a bottom freeze portion. An outer wall freeze portion extends upwardly from the bottom freeze portion to the hidden nailer portion. The hidden nailer portion is secured beneath the sub-facia. The unitary cornice of this invention is made of a single molded or formed element extending from the roof nailer to the hidden nailer adjacent to the upper portion of the outer wall. There are no openings for water to penetrate between multiple parts as the roof portion expands or contracts to changing temperatures.

BRIEF DESCRIPTION OF THE DRAWINGS

The above mentioned and other features and objects of this invention and the manner of attaining them will become more apparent and the invention itself will be best understood by reference to the following description of the invention, when considered in conjunction with the accompanying drawings, wherein.

DESCRIPTION OF THE PREFERRED EMBODIMENT

Figure 4:
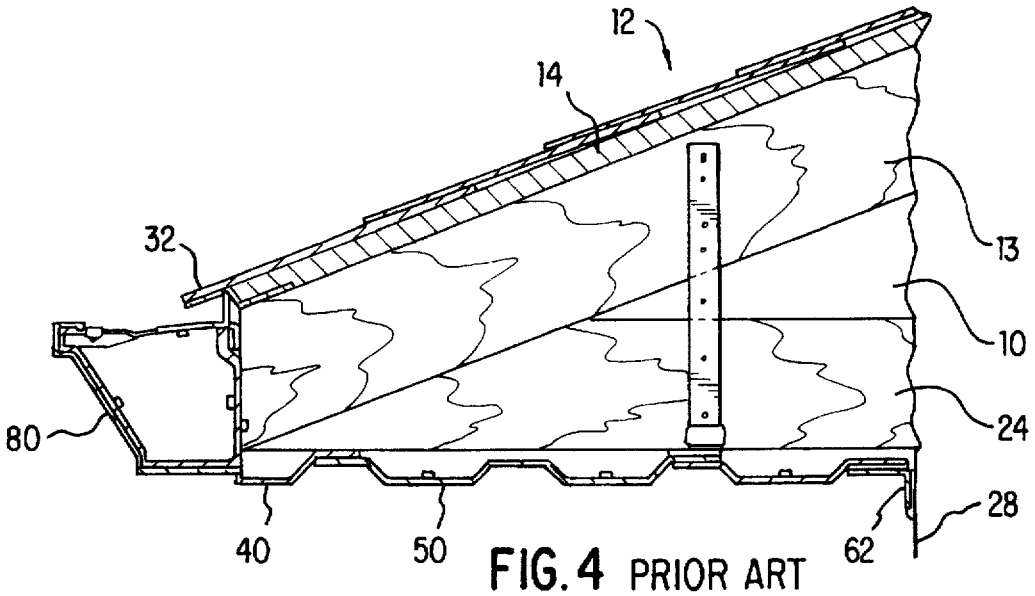
FIG. 4 PRIOR ART
FIG. 4 is a cross-sectional view of an example embodiment of the PRIOR ART.

As shown in cross-section in FIG. 4, the Prior Art comprises a building 10 of conventional construction having a roof 12, formed of spaced rafters 13 typically spaced from twelve to twenty-four inches apart. Roof decking 14 is secured to the rafters 13 and covered with roof shingles 16, or other roofing materials. A conventional facia board 18 having an outer face 20 and a bottom portion 22 is secured to the ends of a plurality of roof rafters 13.

Figure 1:
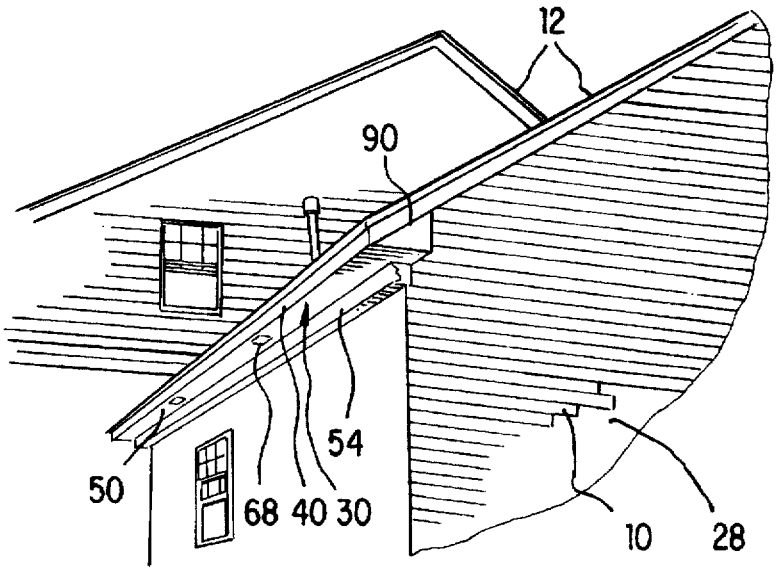
FIG. 1 is a perspective view of the unitary cornice installed upon a building having conventional siding.
Figure 2:
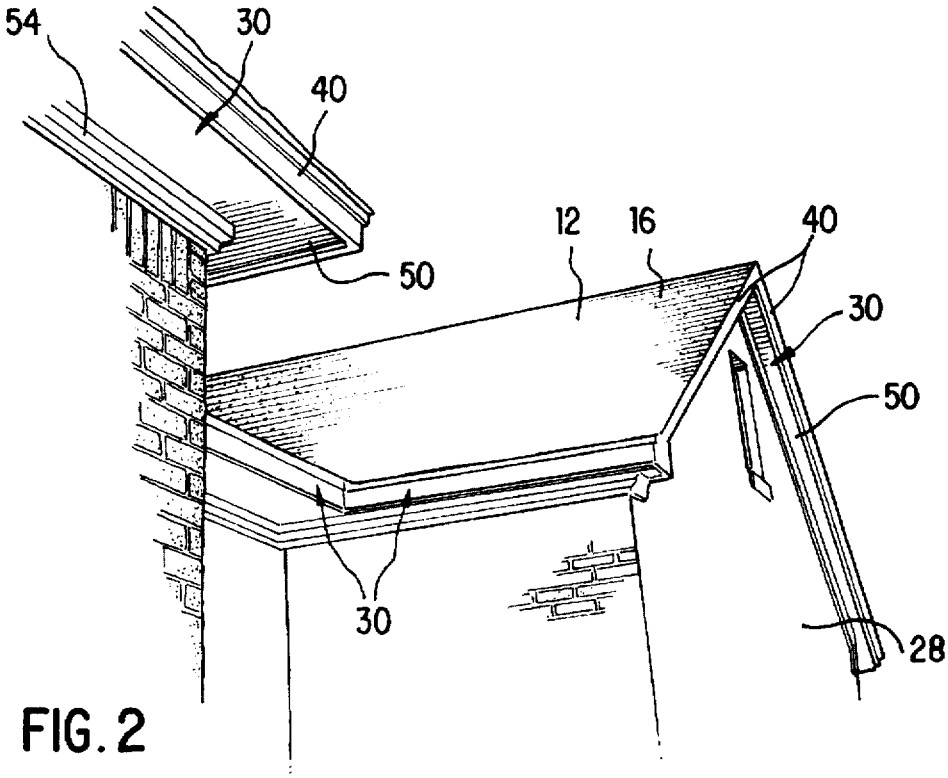
FIG. 2 is a perspective view of the unitary cornice installed upon a building having a brick or masonry wall constructions.

As shown in FIG. 2, the unified cornice apparatus 30 may be used in proximity to brick or masonry walls 28. The unified cornice apparatus 30 may also be used in proximity to conventional outer wood walls 28, covered with paneling, boards or siding, as shown in FIG. 1. Standard sub-facia boards 24 typically extend from six inches to twenty four inches beyond the outer wall 28, and are secured to the upper portion of the outer wall 28, and to the ends of the rafters 13 with conventional fastening means 70 such as nails, bolts, rivets, etc. The outer wall 28 is typically covered with an outer wall covering 29, such as wood siding, aluminum siding, vinyl siding, etc., or is of brick, or masonry construction.

Figure 5:
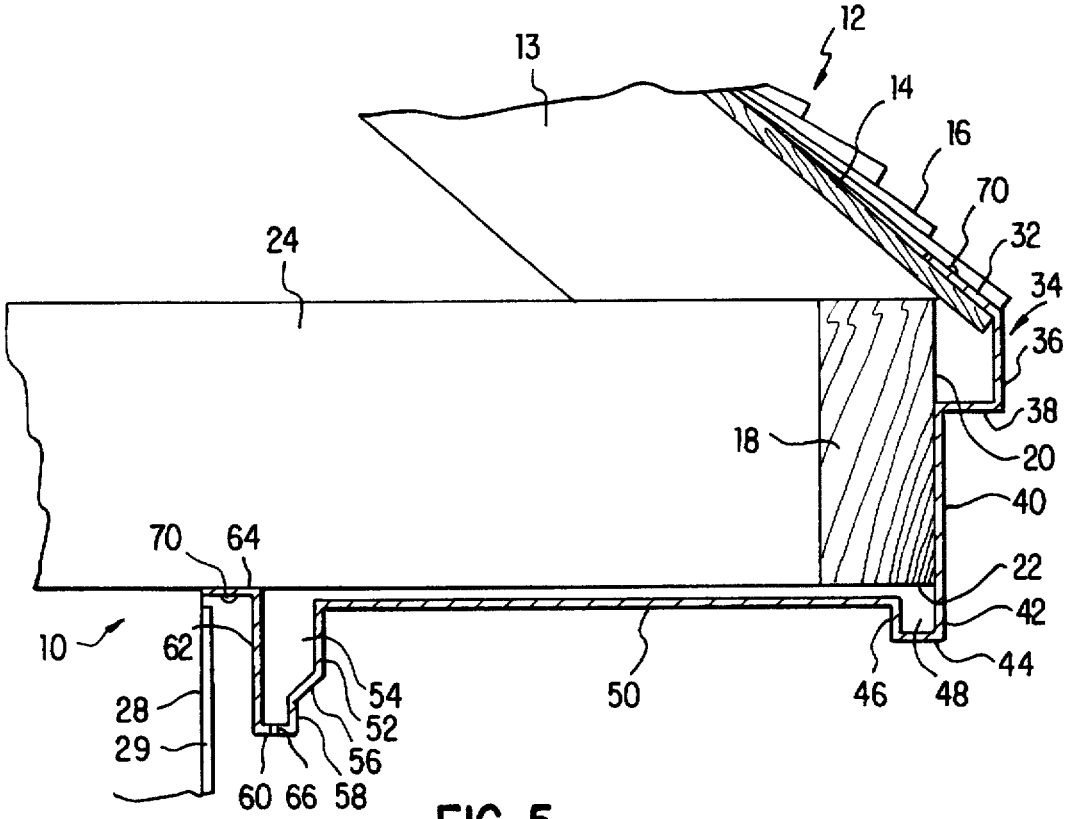
FIG. 5 is a cross-sectional view of the unitary cornice of applicant's invention applied to new construction.
Figure 6:
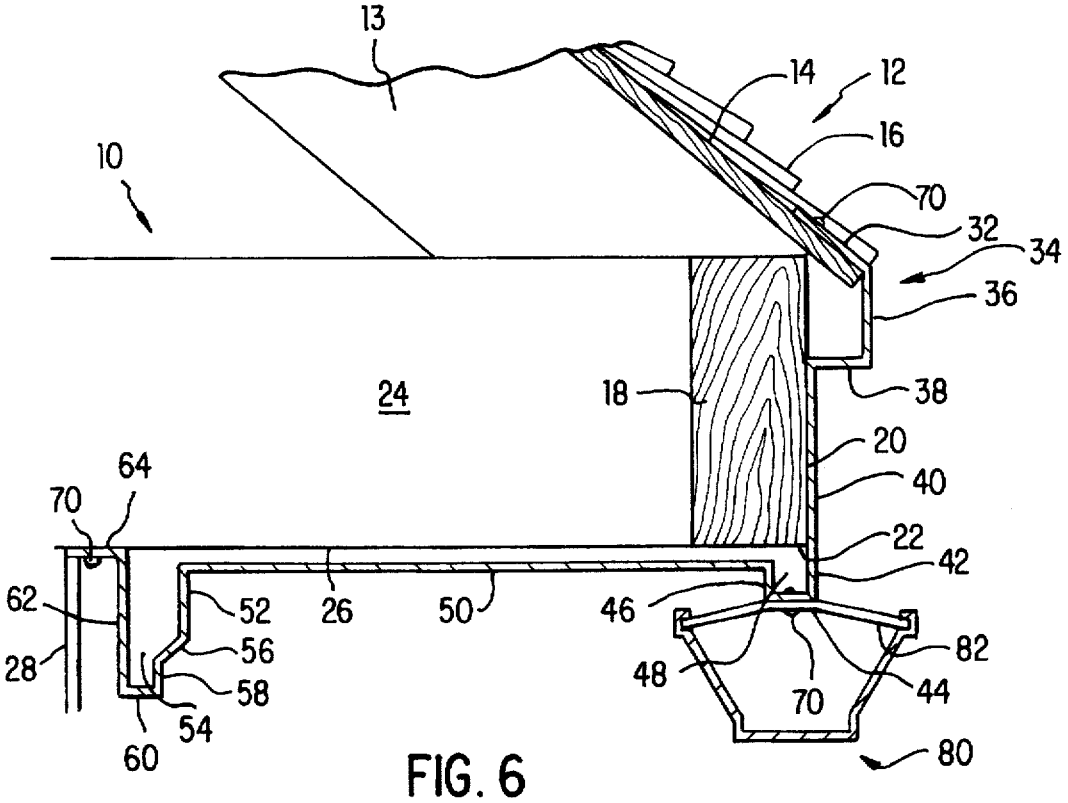
FIG. 6 a cross-sectional view of the unitary cornice showing a gutter mounted beneath the shingle mold portion and beneath the bottom facia channel.

As best shown in FIG. 5, applicant's invention comprises a unitary cornice apparatus 30 having a roof nailer portion 32 positioned adjacent to the roof decking 14. The roof nailer portion 32 extends beneath the roof shingles 16. The roof nailer portion 32 is secured to the roof decking 14 preferably prior to installation of the roof shingles 16. The roof nailer portion 32 is secured to the roof decking 14 with any known fastening means 70, such as nails, staples, gluing, etc.

A shingle mold portion 34 extends downwardly from the roof nailer portion 32 to form an outer face portion 36. A bottom face portion 38 extends inwardly towards the facia board 18 from the outer face portion 36. The shingle mold portion 34 provides for expansion and contraction during temperature variation, as well as adding strength to the unitary cornice 30 in proximity to the roof nailer portion 32. The shingle mold portion further adds a pleasing design characteristic to the unified cornice apparatus 30 of this invention.

The unitary cornice 30 extends from the bottom portion 38 downwardly along the facia board 18 to a lower facia extension 40 which extends below the facia board 18. The unitary cornice 30 extends from the lower facia extension 40, inwardly towards the outer wall 28. The unitary cornice 30 further extends from the bottom facia portion 38 upwardly towards the sub-facia 24 to form an outer soffit portion 46. The facia portion 38 is preferably sized to fit a standard facia board 18, such as a conventional 2×4, 2×6, 2×8, 2×10 or 2×12 lumber. In some instances, a 1×4, 1×6, 1×8, 1×10 or 1×12 lumber may also be used as the facia board 18. Of course, other sizes may also be used without departing from the scope of this disclosure, or the following claims.

The bottom facia extension 42, the bottom facia portion 44 and the outer soffit portion 46 form a bottom facia channel 48 which adds strength and rigidity to the unitary cornice structure 30. The inner portion 49 of the bottom facia channel 48 further serves to trap any water within the unitary cornice apparatus 30. The outer portion 51 of the bottom facia channel 48 further serves as a drip rail to keep water from running along the soffit 50, towards the outer wall 20.

The unitary cornice 30 further extends beneath the sub-facia 24 forming a soffit portion 50. The soffit portion 50 extends from the outer soffit portion 46 to an inner soffit portion 52. The soffit portion 50 is preferably sized to fit standard soffits from six inches to twenty four inches in width. Alternately, when required, the soffit may extend from one-half inch to six inches in width, or more than twenty four inches in width, to suit larger or custom building requirements, without departing from the spirit of this invention, or from the scope of the following claims.

In a preferred embodiment, the inner soffit portion 52 extends downwardly to form a freeze portion 54. The freeze portion 54 further includes an inclined freeze portion 56, which extends from the inner soffit portion 52 to a lower freeze portion 58. A bottom freeze portion 60 extends inwardly towards the outer wall from the lower freeze portion 58.

Figure 7:
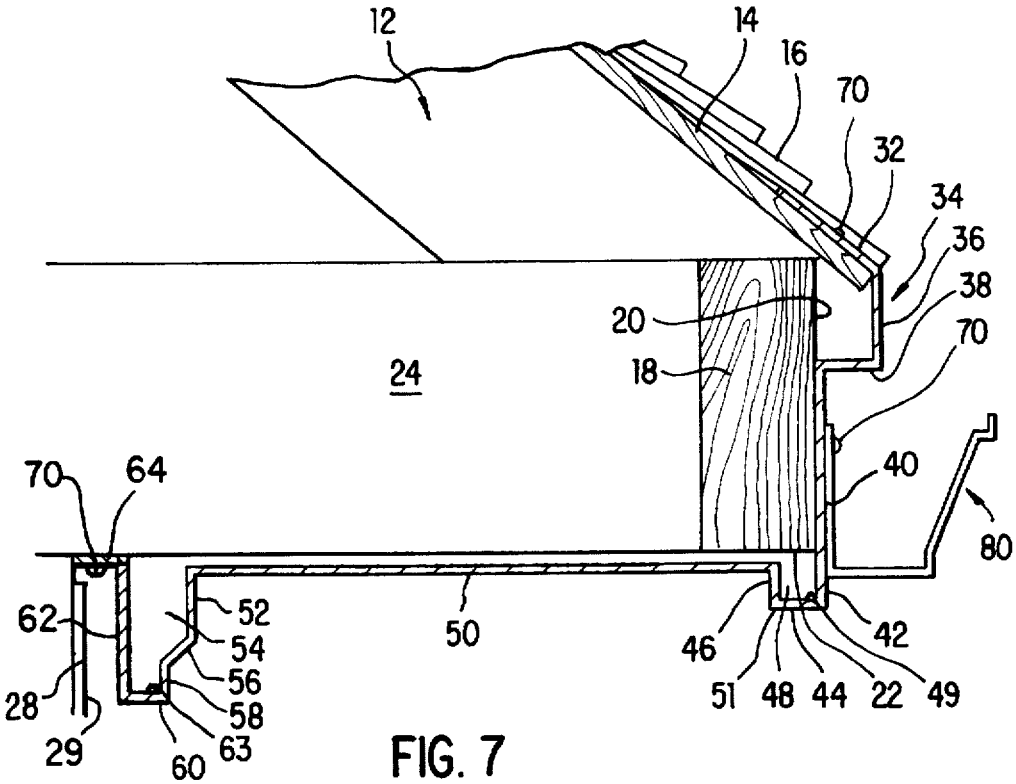
FIG. 7 is a cross-sectional view of the unitary cornice showing a gutter mounted to the facia portion beneath the shingle mold portion, as applied over existing wood frame construction.

When the unitary cornice apparatus 30 is applied over existing wood-framed construction, as shown in FIG. 7, the bottom freeze portion 60 may be secured directly to the bottom of an existing freeze board 72.

Where the unitary cornice apparatus 30 is secured to new construction, as shown in FIG. 5, then an outer wall freeze portion 62 may further extend upwardly forming an outer wall freeze portion 62. The freeze portion 54 serves to keep water from running down the outer wall 28, which over time stains the outer wall 28. The freeze portion 54 further serves as a catch channel 63 for any water which may become trapped beneath the roof decking 14. The freeze portion 54 further provides for expansion as water trapped within the freeze portion 54 expands during freezing, thus further protecting the building 10 from water damage.

A plurality of apertures 66 may be located along the bottom of the freeze portion 60 to promote drainage of any water trapped within the freeze portion 54. A hidden nailer portion 64 preferably extends beneath the sub-facia 24 adjacent to the upper portion of the outer wall 28. Preferably, the unitary cornice apparatus 30 is installed prior to installation of the outer wall covering 29, as shown in FIG. 5.

Alternately, the freeze portion 54 may be made with different profiles to simulate various simulated or existing molding configurations, as best shown in FIG. 7. When the unitary cornice apparatus 30 is applied to new construction as best shown in FIG. 5, the cornice apparatus 30 may be affixed to the sub-facia 24 by a framer, then the siding 29 (brick, vinyl siding, wood siding, etc.) is applied flush against the upper portion of the outer wall 28.

The unitary cornice apparatus 30 disclosed herein is typically from six feet to twenty feet long, with eleven to thirteen feet being the preferred standard length. Shorter lengths may be used where needed to cover the facia 18 and sub-facia 24 along the entire exposed length of the building structure 10. Larger lengths may also be used for larger building projects.

The unitary cornice apparatus 30 disclosed herein is adapted to go around a 90 degree corner to form a bird box type construction 88 which extends into the gable area 90, providing an attractive appearance not found in the prior art. See FIG. 3.

Figure 3:
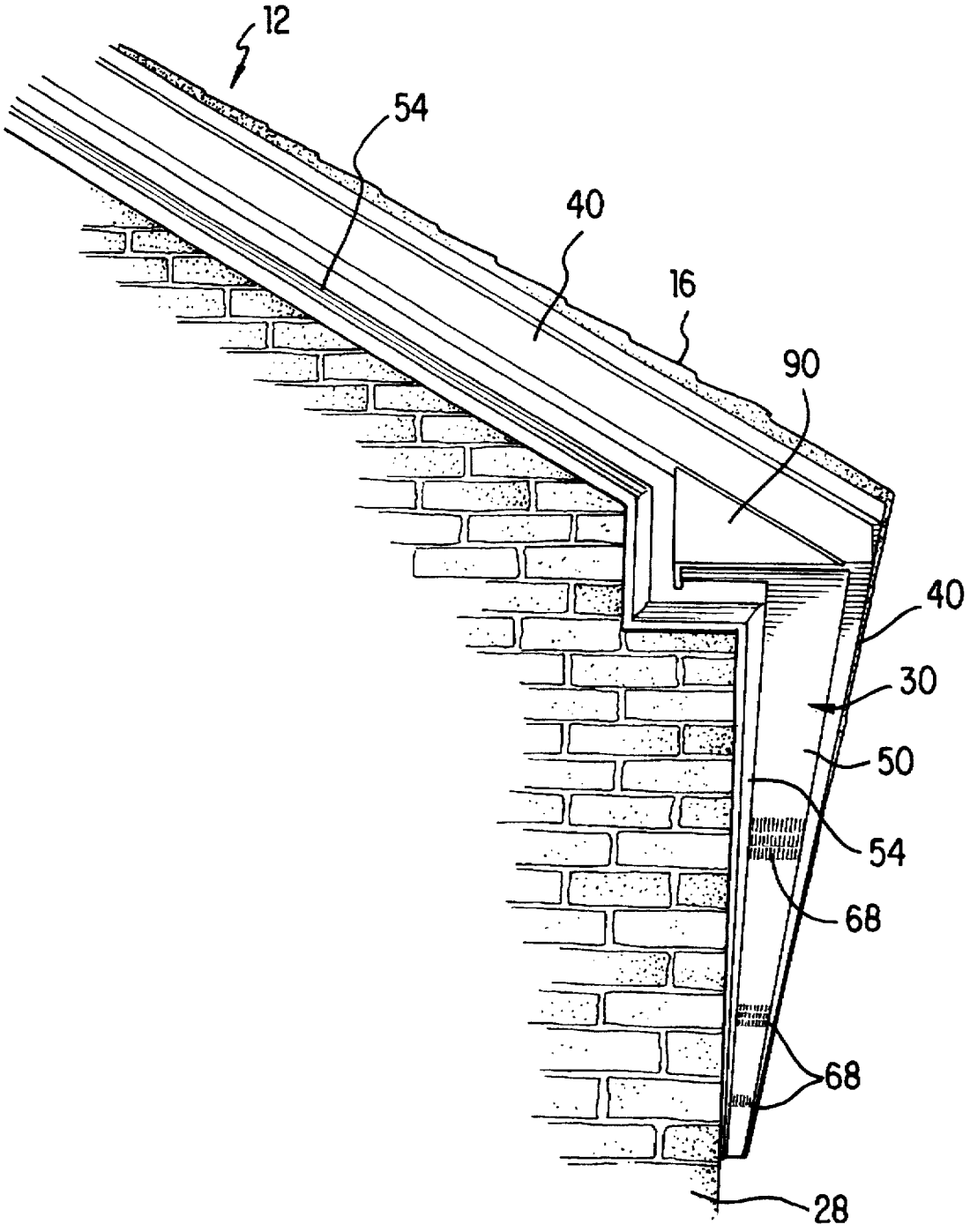
FIG. 3 is a perspective view of the unified cornice showing a corner of the gable area.

Ventilating grills 68 may be installed in spaced relation along the soffit portion 50 to aid roof ventilation, as best shown in FIG. 1 and FIG. 3.

The unitary cornice apparatus 30 disclosed herein may be molded or pre-formed at a remote location in standard sizes for ease of fabrication and installation, or may be formed at the job site by an adjustably positioned forming or rolling fixture (not shown), such as typically used for forming gutters or custom formed panels on-site.

The unitary cornice apparatus 30 may be formed of metal or plastic coil or sheet stock having a preferred uniform thickness of from 0.010 to 0.060 of an inch. Most preferably, the uniform thickness of the flat coil or sheet stock ranges from 0.019 to 0.024 of an inch.

Where a gutter 80 is needed, the gutter 80 may be readily secured to the facia portion 40 to catch runoff from the roof 12 which is designed to drip from the outer face portion 36 of the shingle mold portion 32. Alternately, the gutter 80 may be secured by suitable straps or brackets 82 beneath the bottom facia portion 44, to catch runoff from both the shingle mold portion 34 and the bottom facia portion 44.

The seams 84 between adjacent unitary cornices 30 may be partially overlapped to provide for expansion and contraction. Preferably the seams 84 are overlapped from one-half to six inches, and sealed with a flexible roof sealant (not shown), such as silicone gel or hot tar to prevent water from passing through the seams 84.

The sheet or coil stock is preferably a vinyl clad aluminum or plastic stock having an exterior finish. The exterior finish is preferably a wood grain finish, and is preferably colored to selectively match or contrast with the outer wall 28 or roof trim.

Thus, while the improved unitary cornice 30 has been fully described and disclosed, numerous modifications will become apparent to one of ordinary skill in this art, and such adaptations and modifications are intended to be included within the scope of the following claims.

I claim:

1. A unitary cornice apparatus for covering a fascia and a sub-fascia of a building structure, which comprises:

a) a roof nailer portion;

b) a shingle mold portion having an outer face portion extending downwardly from the roof nailer portion, the shingle mold portion further having a bottom face portion extending from a lower outer face portion to said fascia;

c) a fascia portion extending from the bottom face portion below the fascia to a bottom fascia extension;

d) the unified cornice apparatus further extending from the bottom fascia extension to a bottom fascia portion, and the bottom fascia portion further extending upwardly beneath the sub-fascia to form an outer soffit portion; the bottom fascia extension, the bottom fascia portion and the outer soffit portion forming a bottom fascia channel therebetween;

e) the unified cornice apparatus further extending from the outer soffit portion beneath said sub-fascia to an inner soffit portion;

f) the inner soffit portion extending downwardly to an inclined freeze portion, the inclined freeze portion extending downwardly to a lower freeze portion, the lower freeze portion extending to a bottom freeze portion, the bottom freeze portion extending towards an outer wall freeze portion, the outer wall freeze portion extending upwardly beneath said sub-fascia to form a freeze portion therein;

g) the outer wall freeze portion extending upwardly to a hidden nailer positioned adjacent to the sub-fascia.

2. The unified cornice apparatus of claim 1, wherein a gutter is secured to said fascia portion beneath the shingle mold portion to catch runoff.

3. The unified cornice apparatus of claim 1, wherein a gutter is secured by a plurality of spaced brackets beneath the bottom facia channel, to catch runoff from the shingle mold portion and from the bottom facia channel.

4. The unified cornice apparatus of claim 1, wherein the unified cornice apparatus is made from rolled stock of 0.010 to 0.060 of an inch in thickness.

5. The unified cornice apparatus of claim 4, wherein the unified cornice apparatus is made from rolled stock of 0.019 to 0.024 of an inch in thickness.

6. The unified cornice apparatus of claim 4, wherein the stock material is a vinyl clad aluminum, having an exterior finish.

7. The unified cornice apparatus of claim 1, wherein the unified cornice apparatus is made of plastic stock material of 0.010 to 0.060 thickness.

8. The unified cornice apparatus of claim 1, wherein unified cornice apparatus is sized to fit standard sub-facia widths of six inches to twenty four inches in width.

9. The unified cornice apparatus of claim 1, wherein the unified cornice apparatus is from four feet to twenty feet in length.

10. The unified cornice apparatus of claim 9, wherein the unified cornice is from eleven to thirteen feet in length.

11. The unified cornice apparatus of claim 1, wherein the unified cornice apparatus is formed on-site from a flat coil stock selected from one of a metal and a plastic material.

12. The unified cornice apparatus of claim 1, wherein the unified cornice apparatus is pre-formed in selected standard widths of from six to twenty four inches, and in standard lengths selected from four feet to twenty feet in length.

13. The unified cornice apparatus of claim 1, wherein adjacent unified cornice apparatus are partially overlapped from one-half inch to six inches, and the partially overlapped portion is coated with a flexible sealant.

14. A unified cornice apparatus formed on-site from one of a metal and a plastic sheet stock material, which comprises:

a roof nailer portion connected to a fascia portion, the fascia portion having a shingle mold portion adjacent to the roof nailer portion; the fascia portion further having a bottom fascia channel extending beneath the fascia board; the fascia portion further connected to a soffit portion extending beneath a sub-fascia, the soffit portion connected to a freeze portion extending beneath the sub-fascia; the freeze portion further extending beneath the sub-fascia, and the unitary cornice further extending from the freeze portion along a hidden nailer portion.

15. The unified cornice apparatus of claim 14, wherein a gutter is secured to said facia portion beneath the shingle mold portion to catch and divert water runoff.

16. The unified cornice apparatus of claim 14, wherein a gutter is secured by a plurality of spaced brackets secured beneath the bottom facia channel, to catch and divert water runoff.

17. The unified cornice apparatus of claim 14, wherein the sheet stock material is from 0.010 of an inch to 0.060 of an inch in thickness, and from four to twenty feet in length.

18. The unified cornice apparatus of claim 14, wherein the preferred stock material is from 0.019 to 0.024 of an inch in thickness, and from eleven to thirteen feet in length.

19. The unified cornice apparatus of claim 14, wherein the preferred stock material is a vinyl clad aluminum, having an exterior finish.

20. A unified cornice apparatus which is preformed in selected standard widths of from six to twenty four inches, and in standard lengths selected from four feet to twenty feet in length, which comprises:

a roof nailer portion connected to a fascia portion, the fascia portion having a shingle mold portion adjacent to the roof nailer portion; the fascia portion further having a bottom fascia channel extending beneath the fascia board; the fascia portion further connected to a soffit portion extending beneath a sub-fascia, the soffit portion connected to a freeze portion extending beneath the sub-fascia; the freeze portion further extending beneath the sub-fascia, and the unitary cornice further extending from the freeze portion along a hidden nailer portion.

* * * * *